US007913612B2

(12) United States Patent
Oosima

(10) Patent No.: US 7,913,612 B2
(45) Date of Patent: Mar. 29, 2011

(54) ACTUATOR CONTROL DEVICE

(75) Inventor: Kazumi Oosima, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 530 days.

(21) Appl. No.: 12/086,478

(22) PCT Filed: Dec. 11, 2006

(86) PCT No.: PCT/JP2006/325124

§ 371 (c)(1),
(2), (4) Date: Jun. 13, 2008

(87) PCT Pub. No.: WO2007/069748

PCT Pub. Date: Jun. 21, 2007

(65) Prior Publication Data

US 2009/0282825 A1 Nov. 19, 2009

(30) Foreign Application Priority Data

Dec. 14, 2005 (JP) ..... 2005-360741
Jul. 28, 2006 (JP) ..... 2006-206295

(51) Int. Cl.
*F15B 13/04* (2006.01)

(52) U.S. Cl. ..... 91/447; 91/445

(58) Field of Classification Search ..... 91/420, 91/445, 446, 447
See application file for complete search history.

(56) References Cited

U.S. PATENT DOCUMENTS

| | | | | |
|---|---|---|---|---|
| 4,955,283 | A * | 9/1990 | Hidaka et al. | 91/447 |
| 5,048,395 | A * | 9/1991 | Ohshima | 91/447 |
| 5,065,664 | A | 11/1991 | Ohta et al. | |
| 6,371,006 | B1 * | 4/2002 | Goto et al. | 91/445 |

FOREIGN PATENT DOCUMENTS

| | | |
|---|---|---|
| DE | 19961294 | 6/2001 |
| JP | 2-266103 | 10/1990 |
| JP | 6-45682 | 11/1994 |
| JP | 2001-200805 | 7/2001 |
| JP | 2002-321896 | 11/2002 |

* cited by examiner

*Primary Examiner* — Michael Leslie
(74) *Attorney, Agent, or Firm* — Rabin & Berdo, P.C.

(57) ABSTRACT

In an actuator control device that controls an expansion/contraction operation of a hydraulic cylinder, when a main spool 52 is switched to a discharge position for discharging working fluid in the hydraulic cylinder, a back pressure chamber 7 communicates with a tank passage 13 via a first port 14, thereby opening an operate check valve 51, and as a result, the working fluid in the hydraulic cylinder flows into a return passage 4 from an actuator port 1 and into a pilot chamber 20 through a second port 15. A pilot spool 53 is maintained in a balanced position by the pressure of the pilot chamber 20, which is caused to act by a front-rear differential pressure of a control throttle 25, and the biasing force of a spring 22 housed in a spring chamber 21, and therefore the opening area of the first port 14 is controlled to and maintained at a fixed level.

6 Claims, 4 Drawing Sheets

ACTUATOR CONTROL DEVICE

FIELD OF THE INVENTION

This invention relates to an actuator control device suitable for controlling a lowering operation of a lift cylinder in a forklift or the like.

BACKGROUND OF THE INVENTION

In a known conventional actuator control device that controls an operation of a lift cylinder in a forklift or the like, an operate check valve that allows working oil to flow into the cylinder is provided in a cylinder port, an orifice that communicates with a pilot chamber of the operate check valve is formed in a poppet of the operate check valve, and the pilot chamber is caused to communicate with a tank passage in accordance with the movement of a spool (see JP6-45682 Y2).

SUMMARY OF THE INVENTION

In this type of conventional actuator control device, the operate check valve opens when the pilot chamber of the operate check valve communicates with the tank passage. When the operate check valve opens, pressure acting on the operate check valve decreases rapidly. In this case, the operate check valve is closed again by the spring force action of a spring provided in the pilot chamber. When the operate check valve is closed, the pressure acting on the operate check valve rises such that the operate check valve reopens. This operation is performed repeatedly.

Hence, in a conventional device, the problem of so-called hunting, wherein the operate check valve opens and closes repeatedly, occurs.

This invention has been designed in consideration of this problem, and it is an object thereof to provide an actuator control device capable of suppressing the occurrence of hunting in an operate check valve.

In order to achieve above object, this invention provides an actuator control device that controls an expansion/contraction operation of a hydraulic cylinder. The actuator control device comprises an actuator port connected to the hydraulic cylinder, a main spool that switches the actuator port between communication with a working fluid supply passage and communication with a working fluid return passage, and an operate check valve interposed between the hydraulic cylinder and the main spool, which allows a working fluid to flow from the supply passage to the actuator port, and allows the working fluid to flow from the actuator port to the return passage in accordance with a pressure of a back pressure chamber, wherein, the actuator port communicates constantly with the back pressure chamber of the operate check valve via a connecting passage, the main spool comprises, a pilot spool housed slidably in the main spool, a pilot chamber delimited on one end side of the pilot spool, a spring chamber delimited on another end side of the pilot spool, a biasing member that is housed in the spring chamber and biases the pilot spool against a pressure of the pilot chamber, and a first port that connects the back pressure chamber to a tank passage downstream of the return passage and a second port that connects the return passage to the pilot chamber when the main spool is switched to a discharge position for discharging the working fluid in the hydraulic cylinder, the pilot spool comprises a control throttle that applies resistance to a flow of working fluid flowing out of the pilot chamber into the tank passage, and when the main spool is switched to the discharge position, the pilot spool is maintained in a balanced position by the pressure of the pilot chamber, which acts in accordance with a front-rear differential pressure of the control throttle, and a biasing force of the biasing member in the spring chamber, whereby an opening area of the first port is controlled to and maintained at a fixed level.

According to this invention, when a main spool is switched to a discharge position, a pilot spool is maintained in a balanced position by the pressure of a pilot chamber and the biasing force of a biasing member housed in a spring chamber, and therefore the opening of a first port is maintained at a fixed level. As a result, the pressure of a back pressure chamber delimited by the back surface of a valve body of an operate check valve is maintained at a fixed level, and therefore the occurrence of hunting in the operate check valve is suppressed.

DESCRIPTION OF THE PREFERRED EMBODIMENTS

Figure 1:
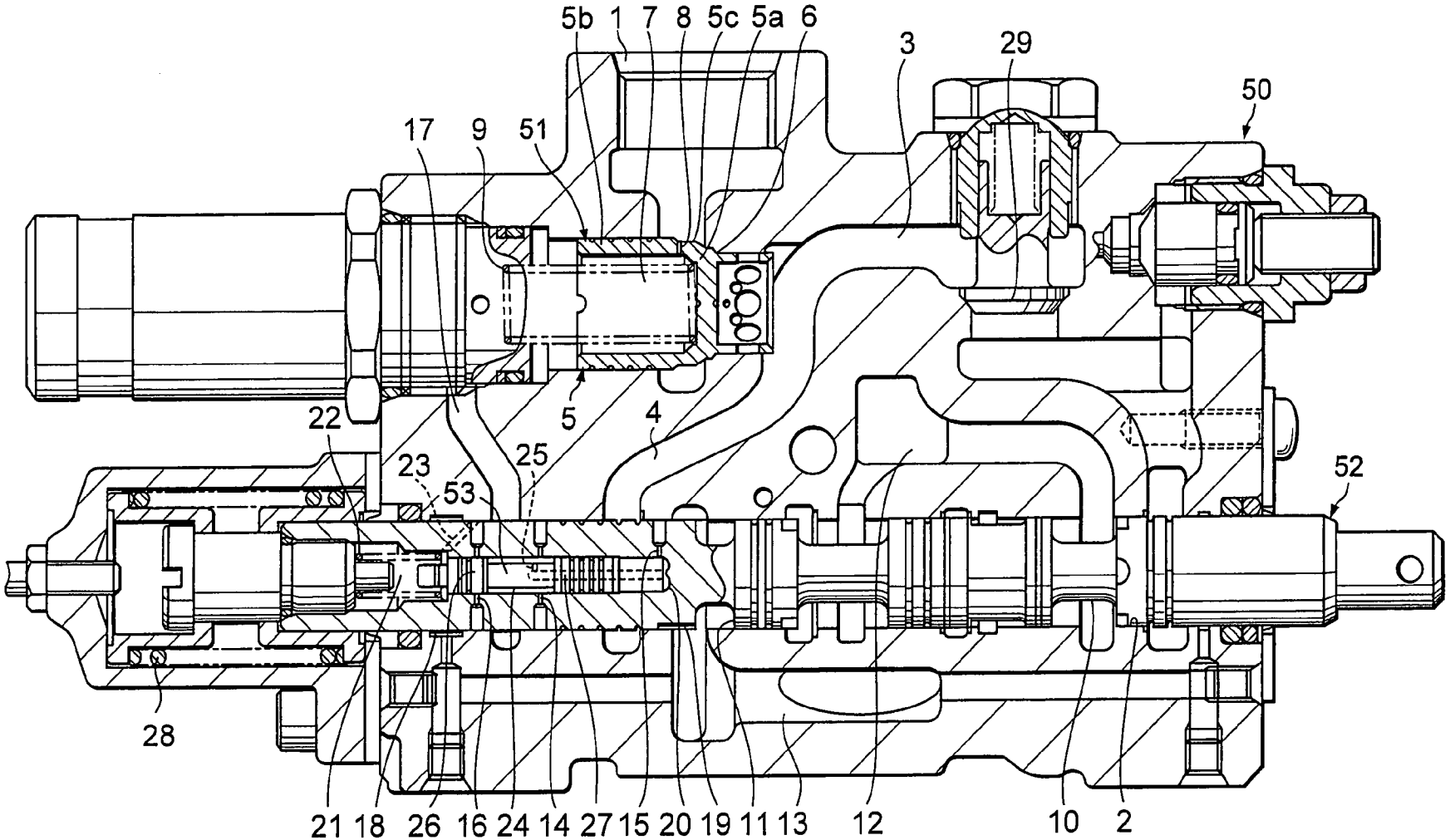
FIG. 1 is a cross-sectional view showing an actuator control device according to a first embodiment of this invention, in a state where a main spool is in a neutral position.

Embodiments of this invention will be described below with reference to the figures.

First Embodiment

First, referring to FIGS. 1 to 3, an actuator control device according to a first embodiment of this invention will be described.

The actuator control device according to this embodiment controls an expansion/contraction operation of a lift cylinder (not shown) of a forklift. The lift cylinder is a hydraulic cylinder driven by a working fluid such as oil.

The actuator control device is formed by incorporating various members into a body 50, and comprises an actuator port 1 connected to the lift cylinder, a main spool 52 which is interposed slidably in a spool hole 2 formed in the body 50 and switches the actuator port 1 between communication with a working fluid supply passage 3 and communication with a working fluid return passage 4, and an operate check valve 51 interposed between the lift cylinder and the main spool 52.

The operate check valve 51 is disposed in a confluence part of the supply passage 3 and return passage 4, and opens and closes a seat portion 6 provided in the body 50 by means of a valve body 5. More specifically, when the valve body 5 opens the seat portion 6, the actuator port 1 communicates with the supply passage 3 and return passage 4. When the valve body 5 is seated on the seat portion 6 such that the seat portion 6 is closed, communication between the actuator port 1 and the supply passage 3 and return passage 4 is blocked.

The valve body 5 comprises a poppet portion 5*a* that blocks passage of the working fluid when seated on the seat portion 6, and a tubular tube portion 5*b* provided on a base end side of the poppet portion 5*a*. An orifice 8 serving as a connecting passage for connecting the actuator port 1 to the interior of the tube portion 5*b* is formed in a fuselage portion of the tube portion 5*b*. A back pressure chamber 7 into which the working fluid in the actuator port 1 is led via the orifice 8 is delimited by a back surface of the valve body 5. Thus, the actuator port 1 communicates with the back pressure chamber 7 at all times through the orifice 8. Further, a spring 9 serving as a biasing member that biases the valve body 5 in a closing direction is housed in the back pressure chamber 7.

A pressure receiving portion 5*c* on which the pressure of the working fluid in the actuator port 1 acts is formed on an outer peripheral surface of the valve body 5 facing the actuator port 1. The working fluid pressure acting on the pressure receiving portion 5*c* causes an opening direction force to act on the valve body 5. Meanwhile, the pressure of the back pressure chamber 7 acts on the back surface of the valve body 5, and this pressure causes a closing direction force to act on the valve body 5. A closing direction pressure receiving area of the valve body 5 is larger than an opening direction pressure receiving area. Therefore, when the pressure acting on the pressure receiving portion 5*c* is equal to the pressure acting on the back surface of the valve body 5, or in other words when the pressure of the actuator port 1 and the pressure of the back surface chamber 7 are equal, the operate check valve 51 is maintained in a closed state.

The main spool 52 is formed with a supply side ring-shaped groove 10 that is in constant communication with a pump passage 12 to which working fluid discharged by a pump (not shown) is led, and a return side ring-shaped groove 11 that is in constant communication with a tank passage 13 to which the working fluid in the return passage 4 is discharged.

When the main spool 52 moves from a neutral position shown in FIG. 1 to a supply position (rightward in FIG. 1) for supplying working fluid to the lift cylinder, the supply passage 3 communicates with the pump passage 12 via the supply side ring-shaped groove 10. Further, when the main spool 52 moves from the neutral position to a discharge position (leftward in FIG. 1) for discharging the working fluid in the lift cylinder, the return passage 4 communicates with the tank passage 13 via the return side ring-shaped groove 11.

A load check valve 29 that allows the working fluid to flow only from the pump passage 12 to the actuator port 1 is interposed in the supply passage 3. Further, a centering spring 28 that biases the main spool 52 to hold it in the neutral position is provided in an end portion of the main spool 52.

A pilot spool 53 is interposed slidably in the interior of the main spool 52 coaxially with the main spool 52. A pilot chamber 20 is delimited on one end side of the pilot spool 53, and a spring chamber 21 is delineated on the other end side.

A spring 22 serving as a biasing member that biases the pilot spool 53 against the pressure of the pilot chamber 20 is housed in the spring chamber 21. In a normal state, the pilot spool 53 is pressed against an end surface of the pilot chamber 20 by the biasing force of the spring 22.

An outer peripheral surface of the pilot spool 53 is partially cut away into a ring shape, and a ring-shaped pressure chamber 24 is formed by the cut away part and an inner peripheral surface of the main spool 52. The pressure chamber 24 is in constant communication with the pilot chamber 20 via a communication passage 27 formed in the pilot spool 53. The pressure chamber 24 and the communication passage 27 are connected by a control throttle 25 that applies resistance to the flow of working fluid from the pilot chamber 20 to the pressure chamber 24. It should be noted that the pilot chamber 20 and pressure chamber 24 may be connected by the communication passage 27, and the control throttle 25 may be interposed in the communication passage 27.

A first port 14, a second port 15 and a third port 16, each having opening portions in an outer peripheral surface and an inner peripheral surface around which the pilot spool 53 slides, are formed in the main spool 52.

One end of the first port 14 communicates with the pressure chamber 24, while the other end is closed by the body 50 when the main spool 52 is in the neutral position. When the main spool 52 moves from the neutral position to the discharge position (leftward in FIG. 1), the other end of the first port 14 communicates with the back pressure chamber 7 via a passage 17 formed in the body 50.

One end of the second port 15 communicates with the pilot chamber 20, while the other end is closed by the body 50 when the main spool 52 is in the neutral position. When the main spool 52 moves from the neutral position to the discharge position, the other end of the second port 15 communicates with the return passage 4.

One end of the third port 16 is closed by a land portion 26 formed in the pilot spool 53 when the pilot spool 53 is held in a normal position shown in FIG. 1 by the action of the spring 22. The other end communicates with the spring chamber 21 via a communication passage 23 formed in the main spool 52. When the main spool 52 moves from the neutral position to the discharge position, the other end of the third port 16 communicates with the tank passage 13 via a ring-shaped groove 18 formed in an inner surface of the spool hole 2. As a result, the spring chamber 21 also communicates with the tank passage 13, via the third port 16 and the ring-shaped groove 18.

When the main spool 52 moves from the neutral position to the discharge position, the first through third ports 14 to 16 described above form the following relative positional relationship: first, the third port 16 communicates with the ring-shaped groove 18; next, the first port 14 communicates with the back pressure chamber 7 via the passage 17, and at the same time, the second port 15 communicates with the return passage 4. As shown in FIGS. 2 and 3, the return passage 4 communicates with the tank passage 13 via a notch 19 formed in the main spool 52 after the second port 15 communicates with the return passage 4.

Next, actions of the actuator control device according to this embodiment will be described.

When the main spool 52 is in the neutral position, communication between the supply passage 3 and the pump passage 12 is blocked and communication between the return passage 4 and the tank passage 13 is blocked. Furthermore, all of the first through third ports 14 to 16 are closed, and communication between the back pressure chamber 7 of the operate check valve 51 and the tank passage 13 is blocked. The working fluid in the actuator port 1 is led to the back pressure chamber 7 through the orifice 8, and therefore a lift cylinder holding pressure acts on the back pressure chamber 7. The closing direction pressure receiving area of the valve body 5 of the operate check valve 51 is larger than the opening direction pressure receiving area, and therefore the operate check valve 51 is maintained in a closed state.

When the main spool 52 moves from the neutral position to the supply position (rightward in FIG. 1), the supply passage 3 communicates with the pump passage 12 via the supply side ring-shaped groove 10. Hence, working fluid supplied to the supply passage 3 from the pump passage 12 passes through the load check valve 29, pushes open the operate check valve 51, and is supplied from the actuator port 1 to the lift cylinder.

Figure 2:
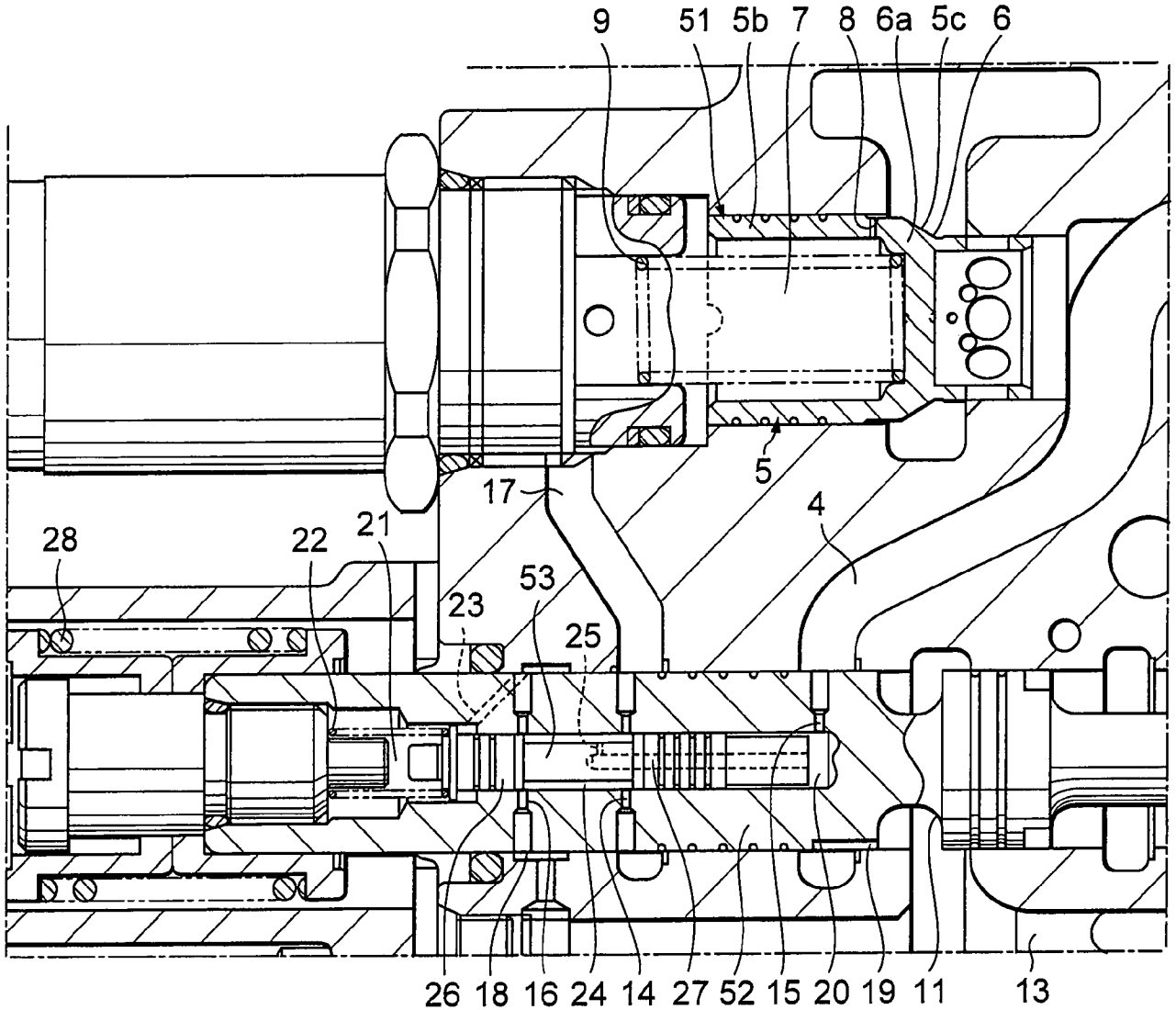
FIG. 2 is a cross-sectional view showing the actuator control device in a state where the main spool is in a discharge position.
Figure 3:
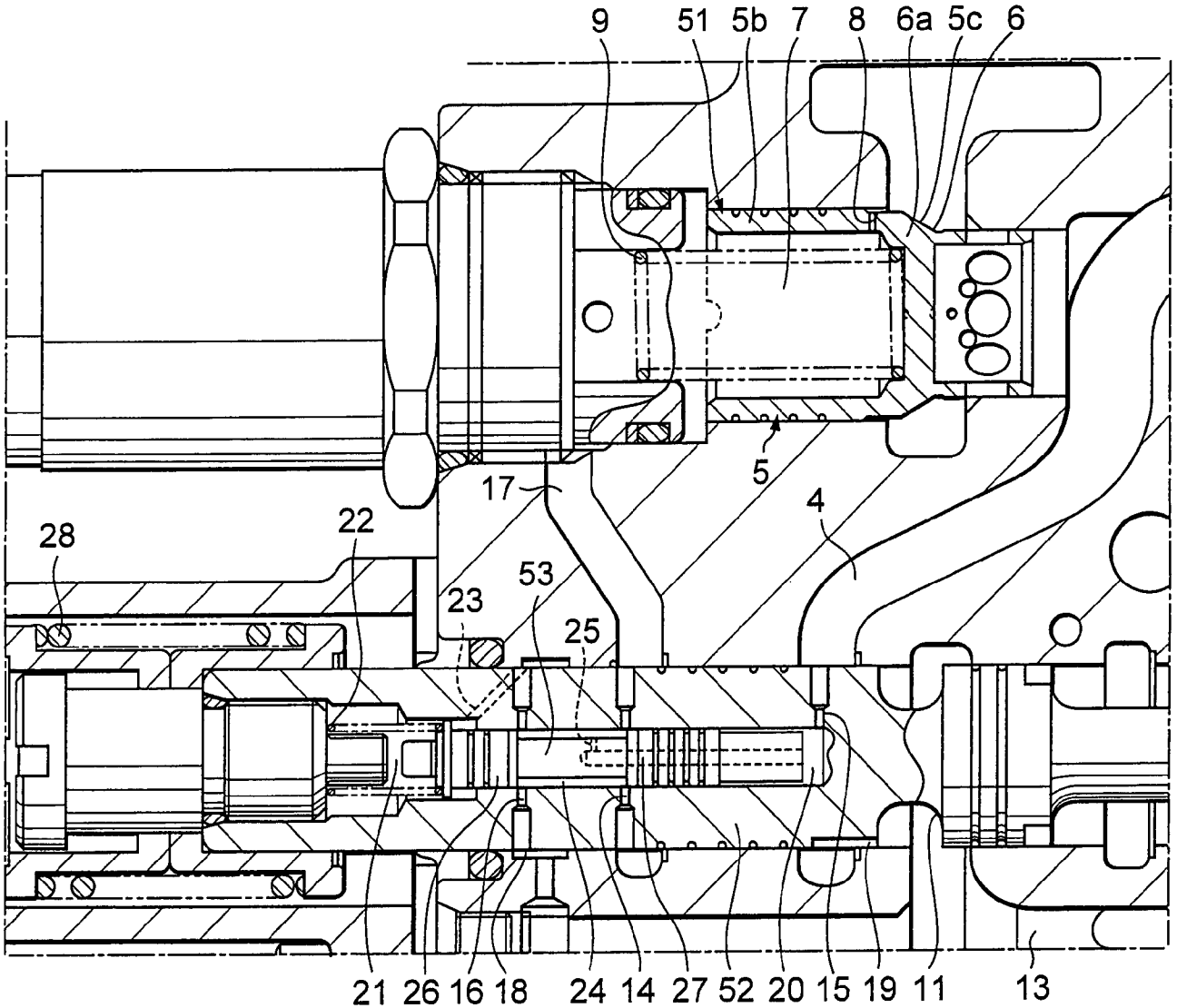
FIG. 3 is a cross-sectional view showing the actuator control device when the main spool is in the discharge position and a first port is in a controlled state.

When the main spool 52 moves from the neutral position to the discharge position (leftward in FIG. 1), first the third port 16 communicates with the tank passage 13 via the ring-shaped groove 18, as shown in FIG. 2. As a result, the spring chamber 21 communicates with the tank passage 13 via the third port 16 and the ring-shaped groove 18. Then, when the main spool 52 moves further leftward, the first port 14 communicates with the back pressure chamber 7 via the passage 17, and at the same time, the second port 15 communicates with the return passage 4.

As a result of the communication between the first port 14 and the back pressure chamber 7, the holding pressure in the back pressure chamber 7 is led to the pilot chamber 20 through the pressure chamber 24 and the control throttle 25. At this time, the spool chamber 21 is held at a tank pressure, and therefore the pilot spool 53 moves in a direction (leftward in FIG. 1) for increasing the volume of the pilot chamber 20 against the spring force of the spring 22.

When the pilot spool 53 moves in this manner, one end of the third port 16 communicates with the pressure chamber 24 on the outer periphery of the pilot spool 53, as shown in FIG. 2. As a result, the first port 14 and third port 16 communicate via the pressure chamber 24, and therefore the back pressure chamber 7 communicates with the tank passage 13 through the passage 17, the first port 14, the pressure chamber 24, the third port 16, and the ring-shaped groove 18, in that order.

When the back pressure chamber 7 communicates with the tank passage 13, the pressure of the back pressure chamber 7 decreases. Accordingly, the poppet portion 5*a* of the valve body 5 is separated from the seat portion 6 by the pressure that acts on the pressure receiving portion 5*c* of the operate check valve 51, thereby opening the operate check valve 51. As a result, the working fluid in the lift cylinder flows to the return passage 4 side from the actuator port 1.

Here, the second port 15 communicates with the return passage 4, and therefore the fluid in the return passage 4 flows into the pilot chamber 20 via the second port 15. As shown in FIG. 3, the working fluid that flows into the pilot chamber 20 passes through the control throttle 25, the pressure chamber 24, the third port 16, and the ring-shaped groove 18 in that order, and then flows into the tank passage 13. Hence, by generating a flow in the control throttle 25, a differential pressure is generated to the front and rear of the control throttle 25, and the upstream side pressure thereof acts on the pilot chamber 20.

As a result, the pilot spool 53 compresses the spring 22 and moves further leftward in the figure. As a result of the movement of the pilot spool 53, the outer peripheral surface of the pilot spool 53 impinges on the opening portion at one end of the first port 14, thereby varying the opening area of the first port 14 relative to the pressure chamber 24, or in other words the opening of the first port 14.

The internal pressure of the pilot chamber 20 varies in accordance with the opening of the first port 14, and therefore the pilot spool 53 is maintained in a balanced position by the internal pressure of the pilot chamber 20 and the biasing force of the spring 22.

More specifically, the pilot spool 53 is maintained in a balanced position in the following manner.

When the pilot spool 53 moves to the left side of the figure, the opening of the first port 14 decreases. As a result, the pressure of the back pressure chamber 7 increases such that the operate check valve 51 moves in the closing direction and the flow rate of the working fluid that flows to the return passage 4 side from the actuator port 1 decreases. Hence, the flow rate of the working fluid that flows into the pilot chamber 20 also decreases, whereby the internal pressure of the pilot chamber 20 decreases and the pilot spool 53 is moved in a direction (rightward in the figure) for reducing the volume of the pilot chamber 20 by the biasing force of the spring 22. When the pilot spool 53 moves rightward in the figure, the opening of the first port 14 increases, and therefore the pressure of the back pressure chamber 7 decreases. As a result, the operate check valve 51 moves in the opening direction, causing the pilot spool 53 to move in a direction (leftward in the figure) for increasing the volume of the pilot chamber 20 against the biasing force of the spring 22.

When the main spool 52 is switched to the supply position in the manner described above, the pressure in the supply passage 3 becomes larger than the pressure in the actuator port 1, and a differential pressure therebetween reaches or exceeds a predetermined value. Hence, the operate check valve 51 opens against the biasing force of the spring 9 such that working fluid is allowed to flow from the supply passage 3 to the actuator port 1. Further, when the main spool 52 is switched to the discharge position, the pressure in the back pressure chamber 7 decreases, and as a result, the operate check valve 51 opens, thereby allowing working fluid to flow from the actuator port 1 to the return passage 4.

Furthermore, the pilot spool 53 controls the opening of the first port 14 at a fixed level by maintaining in a balanced position using the internal pressure of the pilot chamber 20 and the biasing force of the spring 22. When the opening of the first port 14 is controlled to a fixed level, the internal pressure of the back pressure chamber 7 is held at a fixed level in accordance therewith, and as a result, hunting in the operate check valve 51 is prevented.

Moreover, inching control, in which a small amount of working fluid is discharged at a time using the notch 19, can be performed with the pressure in the return passage 4 maintained in a stable state, and therefore the inching control can be performed smoothly. In other words, by holding the main spool 52 in a position where the notch 19 communicates with the return passage 4, a small flow commensurate with the opening of the notch 19 can be returned to the tank passage 13, and as a result, the lift cylinder can be lowered slowly.

Second Embodiment

Figure 4:
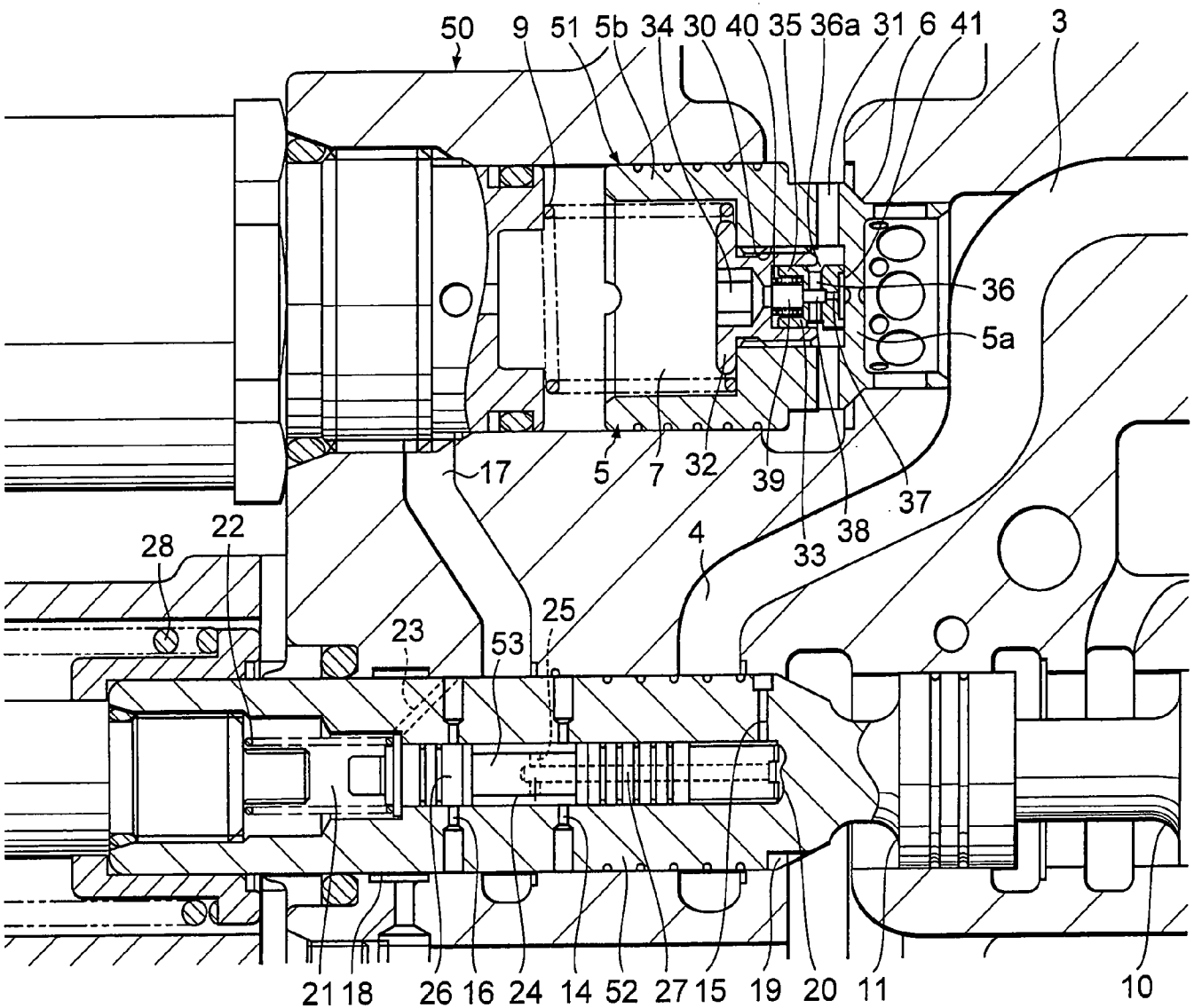
FIG. 4 is a cross-sectional view showing an actuator control device according to a second embodiment of this invention, in a state where a main spool is in a neutral position.

Next, referring to FIG. 4, an actuator control device according to a second embodiment of this invention will be described. It should be noted that identical reference numerals have been allocated to identical members to the first embodiment, and detailed description thereof has been omitted.

The second embodiment differs from the first embodiment in the constitution of the operate check valve 51. The following description will focus on this difference.

A valve hole 30 is formed in an axial direction in the poppet portion 5*a* of the operate check valve 51, and the valve hole 30 is in constant communication with the actuator port 1 via a port 31 serving as a connecting passage. A plug 32 serving as a guide member is fitted into the valve hole 30. It should be noted that the port 31 corresponds to the orifice 8 of the first embodiment described above, but the opening area thereof is considerably larger than that of the orifice 8.

A recessed portion 33 is formed in an end portion of the plug 32, which is inserted into the valve hole 30, and the recessed portion 33 communicates with the back pressure chamber 7 via a passage 34 formed in the plug 32. An auxiliary valve body 35 serving as a second valve body is interposed slidably in the recessed portion 33. Thus, the auxiliary valve body 35 is housed in the valve body 5 of the operate check valve 51 and connects the actuator port 1 and the back pressure chamber 7.

A pilot chamber 41 delimited by contact between a tip end portion of the auxiliary valve body 35 and an end surface of the poppet portion 5*a*, a first control orifice 37 that opens into the pilot chamber 41, a second control orifice 38 that communicates with the first control orifice 37 and has a larger opening diameter than the first control orifice 37, and a spring chamber 39 that communicates with the second control orifice 38, communicates with the back pressure chamber 7 via the passage 34, and is delimited by the back surface of the auxiliary valve body 35, are respectively formed in the auxiliary valve body 35 in axial series. Thus, the pilot chamber 41 and the spring chamber 39 communicate with each other via the first control orifice 37 and second control orifice 38.

A spring 40 serving as a biasing member is housed in the spring chamber 39. The spring 40 biases the auxiliary valve body 35 in a retreating direction from the recessed portion 33 of the plug 32. Hence, when no pressure acts on the pilot chamber 41, the tip end portion of the auxiliary valve body 35 is pressed against the end surface of the poppet portion 5*a* by the biasing force of the spring 40 such that the flow of working fluid through the first control orifice 37 is blocked.

A ring-shaped introduction port 36 that has an opening portion in its outer peripheral surface and communicates with the second control orifice 38 is formed in a fuselage portion of the auxiliary valve body 35. The opening area of an opening portion 36*a* in the outer peripheral surface of the introduction port 36 is determined according to the relative positions of the auxiliary valve body 35 and the plug 32. When the auxiliary valve body 35 is brought into contact with the end surface of the poppet portion 5*a* by the biasing force of the spring 40, the opening portion 36*a* of the introduction port 36 is not closed by the inner peripheral surface of the recessed portion 33 of the plug 32. When the auxiliary valve body 35 advances into the recessed portion 33 of the plug 32 while compressing the spring 40, on the other hand, the opening area of the opening portion 36*a* decreases accordingly. Then, when the auxiliary valve body 35 comes into contact with a bottom surface of the recessed portion 33, the opening portion 36*a* is closed by the inner peripheral surface of the recessed portion 33 of the plug 32. Thus, the opening area of the opening portion 36*a* varies as the auxiliary valve body 35 slides along the inner peripheral surface of the recessed portion 33 of the plug 32.

Next, actions of the actuator control device according to this embodiment will be described.

When the main spool 52 is in the neutral position, communication between the back pressure chamber 7 and the tank passage 13 is blocked, and therefore the pressure of the actuator port 1 and the pressure of the back pressure chamber 7 are equal. At this time, the spring chamber 39 and the pilot chamber 41 delimited on either end of the auxiliary valve body 35 are also at equal pressure, and therefore the auxiliary valve body 35 is held in a normal position, shown in FIG. 4, by the biasing force of the spring 40. In this state, the tip end portion of the auxiliary valve body 35 is held in contact with the end surface of the poppet portion 5*a* by the biasing force of the spring 40, and therefore no flow is generated through the first control orifice 37. On the other hand, the introduction port 36 is open, and therefore the port 31 communicates with the second control orifice 38 via the introduction port 36. Hence, when no pressure acts on the pilot chamber 41, the introduction port 36 communicates with the port 31 and the second control orifice 38 while bypassing the first control orifice 37. In other words, when the auxiliary valve body 35 is in the normal position, the actuator port 1 communicates with the back pressure chamber 7 via the port 31, the introduction port 36, and the second control orifice 38.

Next, a case in which the main spool 52 is moved to the supply position to open the valve body 5 of the operate check valve 51 and then switched to the discharge position in a single stroke, passing straight through the neutral position, will be described. In this case, when the return passage 4 and tank passage 13 are connected while the opening of the valve body 5 is large, the returning fluid from the lift cylinder flows directly into a lap part between the return passage 4 and the return side ring-shaped groove 11. As a result, pressure loss in the lap part increases rapidly, generating shock.

Hence, in this embodiment, measures are taken to ensure that the valve body 5 returns smoothly to a controlled state, thereby reducing shock even when the lift cylinder is lowered in a single stroke after being raised.

When the main spool 52 is switched from the supply position to the discharge position, the back pressure chamber 7 communicates with the tank passage 13, as illustrated above in the first embodiment. As a result, the actuator port 1 communicates with the tank passage 13 via the port 31, the introduction port 36, the second control orifice 38, and the back pressure chamber 7. Accordingly, a flow is generated through the second control orifice 38.

Here, the opening area of the second control orifice 38 is large, and therefore the working fluid from the lift cylinder flows easily into the back pressure chamber 7 through the second control orifice 38. Hence, the pressure of the back pressure chamber 7 increases, and therefore the valve body 5 moves smoothly in the closing direction to return to a controlled state.

When the valve body 5 returns to the controlled state such that the opening of the seat portion 6 decreases to a certain extent, the pressure of the pilot chamber 41 is increased by the action of pressure loss in the fluid passing through the second control orifice 38. Then, when the differential pressure between the pilot chamber 41 and the spring chamber 39 reaches or exceeds a predetermined value, the auxiliary valve body 35 moves against the biasing force of the spring 40 such that the opening portion 36*a* of the introduction port 36 is closed by the inner peripheral surface of the recessed portion 33 of the plug 32. At the same time, the tip end portion of the auxiliary valve body 35 separates from the end surface of the poppet portion 5*a*, and therefore the first control orifice 37 communicates with the port 31 such that the working fluid passes through the first control orifice 37. Thereafter, normal control is performed in an identical manner to the first embodiment.

It should be noted that the auxiliary valve body 35 is set to switch to the first control orifice 37 when the lift cylinder is raised but not to switch when the valve body 5 is reseated. When the auxiliary valve body 35 does not switch, the working fluid bypasses the first control orifice 37, and therefore the auxiliary valve body 35 returns at a higher speed.

According to the embodiments described above, the valve body 5 is returned to a controlled state smoothly even when a rapid switch is performed from a supply mode, in which the working fluid is supplied to the actuator port 1 from the supply passage 3, to a return mode, in which the working fluid is returned to the return passage 4 from the actuator port 1, in a similar manner to the prior art. As a result, shock is alleviated to a greater extent than the prior art.

This invention is not limited to the embodiments described above, and may of course be subjected to various modifications within the scope of the technical spirit thereof.

INDUSTRIAL APPLICABILITY

This invention may be applied to an actuator control device used to control an expansion/contraction operation of a lift cylinder in a forklift.

The invention claimed is:

1. An actuator control device that controls an expansion/contraction operation of a hydraulic cylinder, comprising:

an actuator port connected to the hydraulic cylinder;

a main spool that switches the actuator port between communication with a working fluid supply passage and communication with a working fluid return passage; and an operate check valve interposed between the hydraulic cylinder and the main spool, which allows a working fluid to flow from the supply passage to the actuator port, and allows the working fluid to flow from the actuator port to the return passage in accordance with a pressure of a back pressure chamber, wherein, the actuator port communicates constantly with the back pressure chamber of the operate check valve via a connecting passage, the main spool comprises:

a pilot spool housed slidably in the main spool;

a pilot chamber delimited on one end side of the pilot spool;

a spring chamber delimited on another end side of the pilot spool;

a biasing member that is housed in the spring chamber and biases the pilot spool against a pressure of the pilot chamber; and a first port that connects the back pressure chamber to a tank passage downstream of the return passage and a second port that connects the return passage to the pilot chamber when the main spool is switched to a discharge position for discharging the working fluid in the hydraulic cylinder, the pilot spool comprises a control throttle that applies resistance to a flow of working fluid flowing out of the pilot chamber into the tank passage, and when the main spool is switched to the discharge position, the pilot spool is maintained in a balanced position by the pressure of the pilot chamber, which acts in accordance with a front-rear differential pressure of the control throttle, and a biasing force of the biasing member in the spring chamber, whereby an opening area of the first port is controlled to and maintained at a fixed level.

2. The actuator control device as defined in claim 1, wherein the main spool further comprises:

a third port that is provided so as to communicate with the spring chamber and communicates with the tank passage when the main spool is switched to the discharge position; and a pressure chamber that is delimited by an outer periphery of the pilot spool and connects the first port to the third port when the pilot spool moves against the biasing force of the biasing member in the spring chamber, and when the main spool is switched to the discharge position, the back pressure chamber of the operate check valve communicates with the tank passage through the first port, the pressure chamber, and the third port, whereby the operate check valve opens and the actuator port communicates with the return passage.

3. The actuator control device as defined in claim 1, wherein the operate check valve further comprises a second valve body that is housed in a valve body, connects the actuator port to the back pressure chamber, and moves slidingly along a guide member, the second valve body comprises:

a first control orifice having an opening portion on a tip end portion of the second valve body;

a second control orifice that communicates with the first control orifice and has a larger opening diameter than the first control orifice;

a spring chamber that communicates with both the second control orifice and the back pressure chamber, and is delimited by a back surface of the second valve body;

a biasing member that is housed in the spring chamber and biases the second valve body in a retreating direction from the guide member such that the tip end portion of the second valve body is pressed against the valve body, thereby blocking a flow through the first control orifice; and an introduction port that is capable of introducing the working fluid from the connecting passage into the second control orifice and decreases in opening area as the second valve body moves against a biasing force of the biasing member so as to advance into the guide member, when a front-rear differential pressure of the second control orifice is equal to or smaller than a predetermined value, the actuator port communicates with the back pressure chamber via the introduction port and the second control orifice, and when the front-rear differential pressure of the second control orifice exceeds the predetermined value, the second valve body moves against the biasing force of the biasing member such that the actuator port communicates with the back pressure chamber via the first control orifice.

4. The actuator control device as defined in claim 3, wherein the introduction port has an opening portion on an outer peripheral surface of the second valve body, and when the front-rear differential pressure of the second control orifice exceeds the predetermined value, the opening portion of the introduction port is closed by an inner peripheral surface of the guide member.

5. The actuator control device as defined in claim 2, wherein the operate check valve further comprises a second valve body that is housed in a valve body, connects the actuator port to the back pressure chamber, and moves slidingly along a guide member, the second valve body comprises:

a first control orifice having an opening portion on a tip end portion of the second valve body;

a second control orifice that communicates with the first control orifice and has a larger opening diameter than the first control orifice;

a spring chamber that communicates with both the second control orifice and the back pressure chamber, and is delimited by a back surface of the second valve body;

a biasing member that is housed in the spring chamber and biases the second valve body in a retreating direction from the guide member such that the tip end portion of the second valve body is pressed against the valve body, thereby blocking a flow through the first control orifice; and an introduction port that is capable of introducing the working fluid from the connecting passage into the second control orifice and decreases in opening area as the second valve body moves against a biasing force of the biasing member so as to advance into the guide member, when a front-rear differential pressure of the second control orifice is equal to or smaller than a predetermined value, the actuator port communicates with the back pressure chamber via the introduction port and the second control orifice, and when the front-rear differential pressure of the second control orifice exceeds the predetermined value, the second valve body moves against the biasing force of the biasing member such that the actuator port communicates with the back pressure chamber via the first control orifice.

6. The actuator control device as defined in claim 5, wherein the introduction port has an opening portion on an outer peripheral surface of the second valve body, and when the front-rear differential pressure of the second control orifice exceeds the predetermined value, the opening portion of the introduction port is closed by an inner peripheral surface of the guide member.

* * * * *